US011835019B2

(12) United States Patent
Kimura

(10) Patent No.: US 11,835,019 B2
(45) Date of Patent: Dec. 5, 2023

(54) VENTILATION COMPONENT

(71) Applicant: TOYOTA BOSHOKU KABUSHIKI KAISHA, Aichi-ken (JP)

(72) Inventor: Ryusuke Kimura, Ichinomiya (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/788,201

(22) PCT Filed: May 12, 2021

(86) PCT No.: PCT/JP2021/018058
§ 371 (c)(1),
(2) Date: Jun. 22, 2022

(87) PCT Pub. No.: WO2021/246120
PCT Pub. Date: Dec. 9, 2021

(65) Prior Publication Data

US 2023/0041273 A1 Feb. 9, 2023

(30) Foreign Application Priority Data

Jun. 1, 2020 (JP) ..... 2020-095478

(51) Int. Cl.
*F02M 35/12* (2006.01)
*G10K 11/172* (2006.01)

(52) U.S. Cl.
CPC ..... *F02M 35/12* (2013.01); *G10K 11/172* (2013.01)

(58) Field of Classification Search
CPC ..... F02M 35/12; G10K 11/172
USPC ..... 123/184.57
See application file for complete search history.

(56) References Cited

U.S. PATENT DOCUMENTS

2018/0298855 A1 10/2018 Kimura
2019/0136806 A1 5/2019 Kimura

FOREIGN PATENT DOCUMENTS

CN 107731216 A * 2/2018
DE 102018108571 A1 10/2018
DE 102018127742 A1 5/2019
JP 8-152890 6/1996
JP 9-256834 9/1997
JP 2001306080 A * 11/2001

OTHER PUBLICATIONS

JP2001306080A (Kyoichi, Watanabe) (Nov. 2, 2001) (Machine Translation) (Year: 2001).*

(Continued)

*Primary Examiner* — Mahmoud Gimie
(74) *Attorney, Agent, or Firm* — Greenblum & Bernstein, P.L.C.

(57) ABSTRACT

A ventilation component includes a circumferential wall. At least a part of the circumferential wall is formed by the wall portion, which includes the inner layer and the outer layer. The inner layer contains fibers and has permeability, and the outer layer is provided on the radially outer side of the inner layer and has elasticity. The wall portion forms a vibration system including the inner layer as a mass portion and the outer layer as a spring portion. The vibration system has a partially varying natural frequency.

4 Claims, 2 Drawing Sheets

(56) References Cited

OTHER PUBLICATIONS

International Search Report, in International Patent Application No. PCT/JP2021/018058, dated Jul. 20, 2021, with English translation.
German Office Action in German counterpart application No. DE112021003087.6, dated Aug. 29, 2023.

* cited by examiner

VENTILATION COMPONENT

TECHNICAL FIELD

The present disclosure relates to a ventilation component used, for example, in an intake duct of an internal combustion engine.

BACKGROUND ART

Patent Literature 1 discloses a conventional sound absorbing material that is used in a ventilation component used in an intake duct of an internal combustion engine. Such a sound absorbing material includes a laminated structure having a high-density layer and a low-density layer. The high-density layer is arranged on the inner side and made of fibers. The low-density layer is arranged on the outer side of the high-density layer. The laminated structure includes a mass-spring system. The mass-spring system includes the high-density layer as a mass portion and the low-density layer as a spring portion, so as to attenuate the energy of sound.

CITATION LIST

Patent Literature

Patent Document 1: Japanese Laid-Open Patent Publication No. 8-152890

SUMMARY OF INVENTION

Technical Problem

The above-described sound absorbing material uses the mass-spring system to adjust target sound waves of a frequency desired to be attenuated. The sound absorbing material can attenuate sound waves of only a single frequency. Since the sound absorbing material cannot attenuate sound waves of multiple frequencies, the sound absorbing material still has room for improvement in noise reducing performance.

It is an objective of the present disclosure to provide a ventilation component that improves the noise reducing performance of a wall portion.

Solution to Problem

To achieve the foregoing objective, a ventilation component includes a circumferential wall. At least a part of the circumferential wall is formed by a wall portion. The wall portion includes an inner layer that contains fibers and has air permeability, and an outer layer that is provided on a radially outer side of the inner layer and has elasticity. The wall portion forms a vibration system including the inner layer as a mass portion and the outer layer as a spring portion. The vibration system has a partially varying natural frequency.

DESCRIPTION OF EMBODIMENTS

A ventilation component according to an embodiment will now be described with reference to the drawings. The ventilation component is an intake duct for an internal combustion engine.

Figure 1:
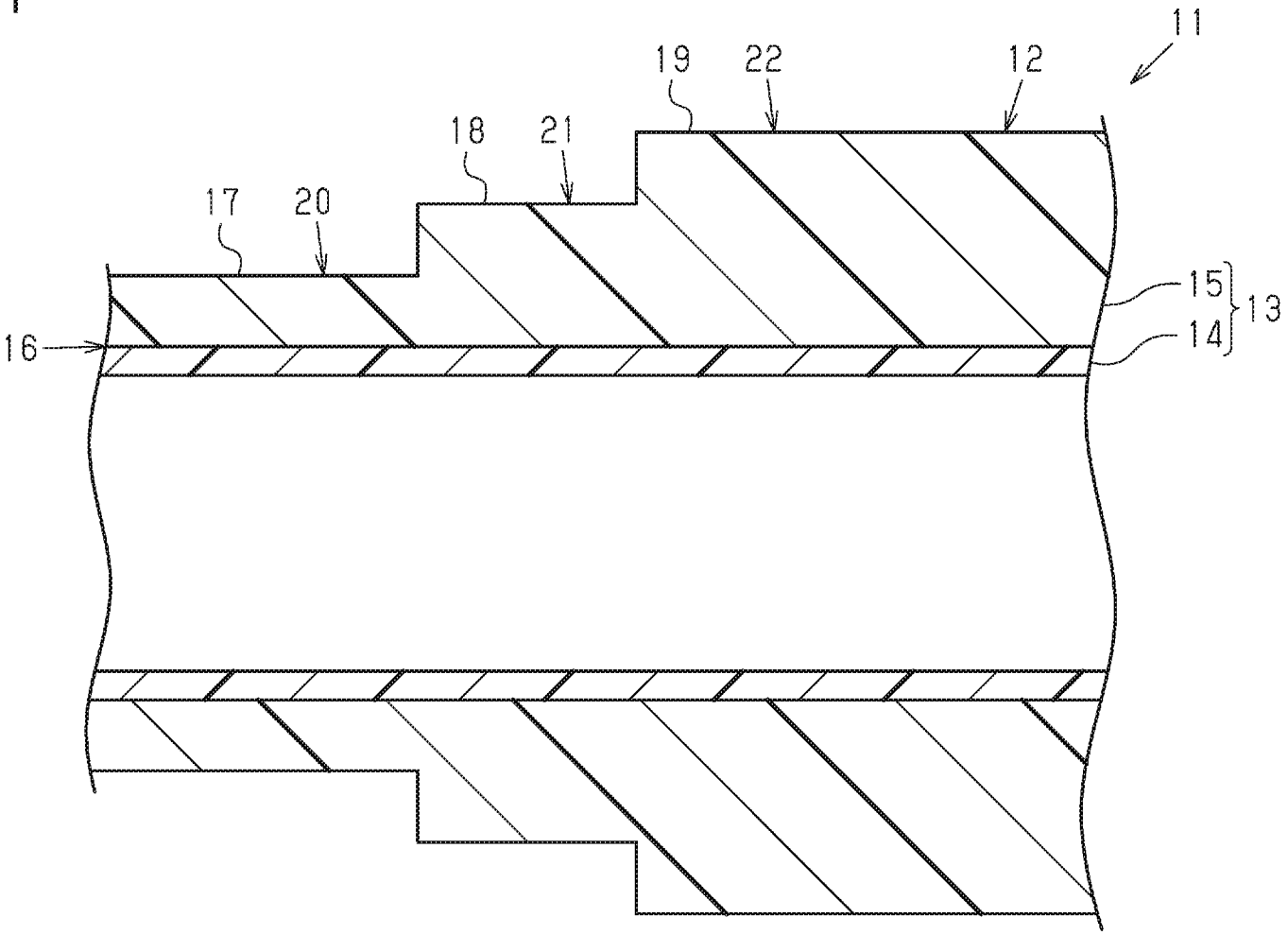
FIG. 1 is a cross-sectional view showing part of an intake duct according to an embodiment.

As shown in FIG. 1, an intake duct 11, which is one example of the ventilation component, has a substantially cylindrical shape. The intake duct 11 includes a cylindrical circumferential wall 12. The circumferential wall 12 is at least partly formed by a wall portion 13 containing fibers. The circumferential wall 12 of the present embodiment is entirely formed by the wall portion 13. The wall portion 13 of the present embodiment is made of nonwoven fabric that has been subjected to thermal compression molding.

The wall portion 13 includes a cylindrical inner layer 14, which is located on a radially inner side in the circumferential wall 12, and a cylindrical outer layer 15, which is provided on a radially outer side of the inner layer 14 and has elasticity. The inner layer 14 and the outer layer 15 both contain fibers and have air permeability. The air permeability of the inner layer 14 is lower than the air permeability of the outer layer 15. The inner layer 14 and the outer layer 15 are joined to each other by intertwining fibers of nonwoven fabric of the inner layer 14 and the outer layer 15 through needle punching.

Since the inner layer 14 and the outer layer 15 are joined to each other without using adhesive, a boundary 16 between the inner layer 14 and the outer layer 15 has air permeability. In this case, the air permeability of the boundary 16 is greater than or equal to the air permeability of the inner layer 14. The thickness of the inner layer 14 is less than the thickness of the outer layer 15. That is, the compression ratio of the inner layer 14 is greater than the compression ratio of the outer layer 15. Thus, the inner layer 14 has a higher density than the outer layer 15.

The wall portion 13 forms a single degree-of-freedom mass-spring system that is a vibration system including the inner layer 14 as a mass portion and the outer layer 15 as a spring portion. The outer layer 15 is formed to have a partially varying thickness so that the mass-spring system has a partially varying natural frequency. In general, the natural frequency of a mass-spring system is changed by changing at least one of a mass portion (permeability of the inner layer 14) and the spring constant of a spring portion (thickness of the outer layer 15).

In the wall portion 13 of the present embodiment, the inner layer 14 has a constant thickness, and the outer layer 15 has a partially varying thickness, so that the spring portion of the mass-spring system has a partially varying spring constant. Accordingly, the mass-spring system has a partially varying natural frequency. That is, in the wall portion 13 of the present embodiment, the inner layer 14 has a constant thickness, while the thickness of the outer layer 15 varies in three steps.

The outer layer 15 includes a first thickness portion 17, a second thickness portion 18, and a third thickness portion 19. The first thickness portion 17 has the smallest thickness in the radial direction among the three thickness portions 17, 18, and 19. The second thickness portion 18 is adjacent to the first thickness portion 17 and has a larger thickness in the radial direction than the first thickness portion 17. The third thickness portion 19 is adjacent to the second thickness portion 18 and has a larger thickness in the radial direction than the second thickness portion 18. Accordingly, a step is formed between the first thickness portion 17 and the second thickness portion 18, and a step is formed between the second thickness portion 18 and the third thickness portion 19.

Thus, the spring constant of the first thickness portion 17, the spring constant of the second thickness portion 18, and the spring constant of the third thickness portion 19 are different from one another. Therefore, the wall portion 13 includes a first wall portion 20, which corresponds to the first thickness portion 17, a second wall portion 21, which corresponds to the second thickness portion 18, and a third wall portion 22, which corresponds to the third thickness portion 19. The natural frequencies of the first to third wall portions 20 to 22 are different from one another.

Operation of the intake duct 11 will now be described.

When intake air (air) flows through a space on the inner side of the wall portion 13, which forms the circumferential wall 12 of the intake duct 11, the intake air generates sound waves of various frequencies. Among these sound waves, the sound wave whose frequency is equal to the natural frequency of the first wall portion 20 is efficiently attenuated by resonating with the first wall portion 20, the sound wave whose frequency is equal to the natural frequency of the second wall portion 21 is efficiently attenuated by resonating with the second wall portion 21, and the sound wave whose frequency is equal to the natural frequency of the third wall portion 22 is efficiently attenuated by resonating with the third wall portion 22.

As such, since the wall portion 13 of the intake duct 11 has multiple (three in this example) natural frequencies, sound waves of multiple (three in this example) frequencies are attenuated effectively by resonating with the first wall portion 20, the second wall portion 21, and the third wall portion 22. This effectively reduces the levels of noises generated by intake air flowing through the space on the inner side of the wall portion 13.

In addition, the pressure of the sound waves of the intake air flowing through the space on the inner side of the wall portion 13 vibrates the fibers of the outer layer 15 when passing through the outer layer 15 of the wall portion 13, so as to be converted into thermal energy. The pressure is thus attenuated. Since the generation of standing waves of the sound waves of the intake air is suppressed, the noise caused by the flow of intake air is reduced. This reduces the generation of noise due to the flow of intake air through the space inside the wall portion 13, and thus reduces radiated sound emitted to the outside of the wall portion 13.

Since the wall portion 13 has air permeability, the air outside the wall portion 13 attempts to enter the space on the inner side of the wall portion 13. However, since the inner layer 14 of the wall portion 13 has a lower air permeability than the outer layer 15 in the intake duct 11 according to the present embodiment, the inner layer 14 reliably prevents the air outside the wall portion 13 from entering the space on the inner side of the wall portion 13. That is, the inner layer 14 controls air permeation of the wall portion 13, which forms the circumferential wall 12. Accordingly, the intake air that flows through the space on the inner side of the wall portion 13 will not be adversely affected by air that enters the space on the inner side of the wall portion 13 from outside the wall portion 13. This reduces the pressure loss of the intake air flowing through the space on the inner side of the wall portion 13.

The above-described embodiment achieves the following advantages.

(1) The intake duct 11 includes the circumferential wall 12. At least a part of the circumferential wall 12 is formed by the wall portion 13, which includes the inner layer 14 and the outer layer 15. The inner layer 14 contains fibers and has permeability, and the outer layer 15 is provided on the radially outer side of the inner layer 14 and has elasticity. The wall portion 13 forms a vibration system including the inner layer 14 as a mass portion and the outer layer 15 as a spring portion. The vibration system has a partially varying natural frequency. Since the wall portion 13 has multiple natural frequencies in this configuration, it is possible to reliably attenuate sound waves of different frequencies of the intake air flowing through the intake duct 11 by causing the sound waves to resonate. This improves the noise reducing performance of the wall portion 13 in an effective manner. Also, the natural frequencies of the wall portion 13 can be adjusted to attenuate sound waves of desired frequencies (for example, relatively low frequencies lower than or equal to a frequency of 1000 Hz to 500 Hz).

(2) The outer layer 15 of the intake duct 11 contains fibers and has air permeability. The outer layer 15 has a partially varying thickness. This configuration allows the outer layer 15 to have a partially varying spring constant simply by partially varying the thickness of the outer layer 15. This readily allows the wall portion 13 to have a partially varying natural frequency.

(3) In the intake duct 11, the inner layer 14 has a higher density than the outer layer 15. With this configuration, the inner layer 14 has a smooth inner surface and thus reduces the pressure loss of the intake air flowing along the inner side of the inner layer 14 (the wall portion 13).

(4) In the intake duct 11, the inner layer 14 and the outer layer 15 are joined to each other by intertwining the fibers of the inner layer 14 and the outer layer 15 through needle punching. This configuration joins the inner layer 14 and the outer layer 15 to each other without preparing any additional material such as adhesive to join the inner layer 14 and the outer layer 15 to each other.

(5) The circumferential wall 12 of the intake duct 11 is entirely formed by the wall portion 13, which is made of a nonwoven fabric having air permeability. This configuration reduces the weight of the intake duct 11 as compared to a case in which the circumferential wall 12 is entirely formed by a hard plastic that does not have air permeability.

Modifications

The above-described embodiment may be modified as follows. The above-described embodiment and the following modifications can be combined as long as the combined modifications remain technically consistent with each other.

Figure 2:
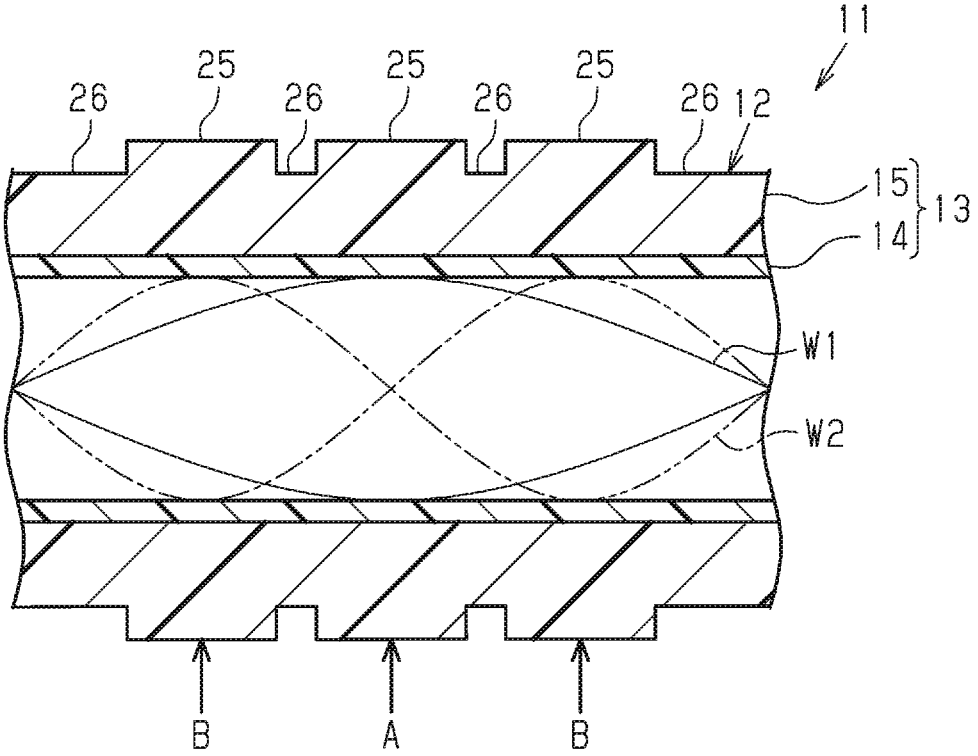
FIG. 2 is an enlarged partial cross-sectional view illustrating an intake duct according to a modification.

As shown in FIG. 2, the outer layer 15 of the intake duct 11 may include air permeable portions 25, which have air permeability, and non-permeable portions 26, which do not have air permeability. The air permeable portions 25 may be arranged at positions corresponding to antinodes of standing waves of the sound waves of the intake air flowing through the space on the inner side of the circumferential wall 12. In this case, the outer layer 15 has a partially varying compression ratio to provide the air permeable portions 25, which have air permeability, and the non-permeable portions 26, which do not have air permeability. That is, high-compression portions of the outer layer 15, which have a small thickness in the radial direction, are the non-permeable portions 26, and low-compression portions of the outer layer 15, which have a large thickness in the radial direction, are the air permeable portions 25. Further, the standing waves of the sound waves of the intake air flowing through the space on the inner side of the circumferential wall 12 include a first order standing wave W1 and a second order standing wave W2. The air permeable portions 25 are arranged at positions A, which correspond to antinodes of the first order standing wave W1, and positions B, which correspond to antinodes of the second order standing wave W2.

With this configuration, the intake air flowing through the space on the inner side of the circumferential wall 12 has sound waves of different frequencies, and the air permeable portions 25 are arranged at the positions A and B, which correspond to the highest sound pressure of those sound waves. Also, the non-permeable portions 26 are provided at positions where the air permeable portions 25 are not present. Thus, the circumferential wall 12 as a whole reduces radiated sound emitted to the outside from the space on the inner side of the circumferential wall 12, and the air that enters the space on the inner side of the circumferential wall 12 from the outside of the circumferential wall 12. Accordingly, the pressure loss of the intake air flowing through the space on the inner side of the circumferential wall 12 is reduced. In this case, the air permeable portions 25 and the non-permeable portions 26 form steps on the outer circumferential surface of the circumferential wall 12, which increases the surface stiffness of the circumferential wall 12. This reduces shaking of the circumferential wall 12 due to sound waves. Accordingly, this configuration further reliably reduces radiated sound emitted to the outside from the space on the inner side of the circumferential wall 12.

Figure 3:
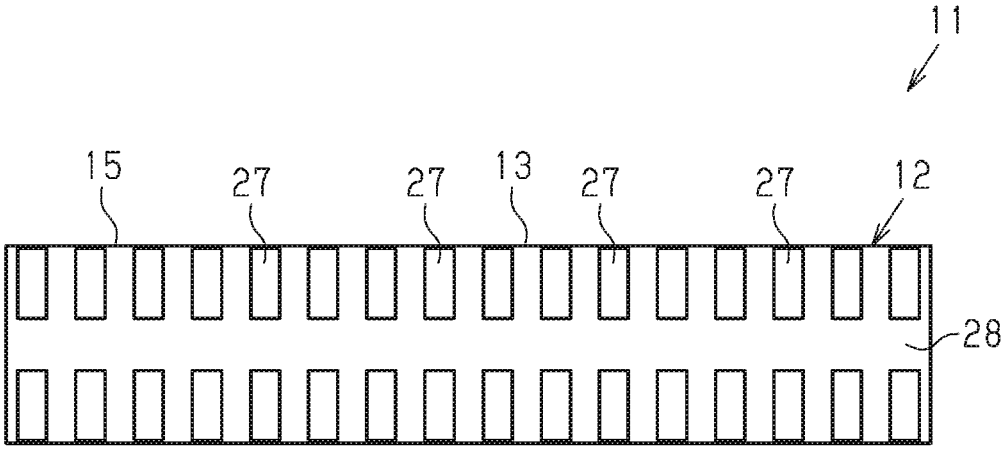
FIG. 3 is a side view of an intake duct according to a modification.

As shown in FIG. 3, the outer layer 15 of the intake duct 11 may include high-compression portions 27, which have little air permeability, and a low-compression portion 28, which is compression-molded at a compression ratio lower than that of the high-compression portions 27 and has air permeability. The low-compression portion 28 may be formed to extend continuously in the axial direction (left-right direction as viewed in FIG. 3) over the entire outer layer 15. Normally, the sound pressure of a standing wave of the sound waves of the intake air is highest at positions corresponding to antinodes of the standing wave in the intake duct 11. If the low-compression portion 28, which has air permeability, is located at these positions, the pressure of the sound waves of the intake air is relieved through the low-compression portion 28. This suppresses the generation of standing waves in an effective manner. In this regard, the above-described configuration has the low-compression portion 28, which continuously extends in the axial direction over the entire outer layer 15. Thus, the low-compression portion 28 is present at positions corresponding to antinodes of standing waves of sound waves of various frequencies that can be generated in the space inside the intake duct 11. This reduces intake noise of a wide frequency range.

The wall portion 13 may be formed to have a partially varying natural frequency by causing the outer layer 15 to have a constant thickness, and the inner layer 14 to have a partially varying air permeability. In this case, the inner layer 14 may be formed to have a partially varying air permeability, for example, by partially varying the compound ratio of the binder.

The outer layer 15 may be configured such that the first thickness portion 17, the second thickness portion 18, and the third thickness portion 19, which have different thicknesses, have the same density through foam molding of glass wool or urethane.

The outer layer 15 does not necessarily need to have air permeability. That is, the outer layer 15 may be impermeable to air.

The thickness in the radial direction of the outer layer 15 varies in three steps with the first thickness portion 17, the second thickness portion 18, and the third thickness portion 19 in the above-described embodiment. However, the thickness may vary in four or more steps.

The circumferential wall 12 of the intake duct 11 does not necessarily need to be entirely formed by the wall portion 13. That is, the circumferential wall 12 may be partly formed by the wall portion 13.

The inner layer 14 of the intake duct 11 does not necessarily need to have a density higher than that of the outer layer 15. That is, the inner layer 14 may have a density lower than or equal to that of the outer layer 15.

A water repellent may be applied to the outer circumferential surface of the outer layer 15 of the intake duct 11. For example, fluorine coating may be formed on the outer circumferential surface of the outer layer 15 so that the outer circumferential surface has water repellency. In this case, the water repellent is preferably applied to the outer circumferential surface of the outer layer 15 such that the air permeability of the outer layer 15 is maintained.

The intake duct 11 does not necessarily need to be cylindrical, but may have a tubular shape with a polygonal cross-sectional shape including a rectangular shape or a hexagonal shape, or an elliptic cross-sectional shape.

The ventilation component is not limited to the intake duct 11, but may be an inlet duct, an air cleaner, a supply air duct or an outside air duct for an air conditioner, a duct that supplies cooling air to a motor of a battery electric vehicle, or a duct that supplies oxygen to a fuel cell stack of a fuel cell electric vehicle.

The invention claimed is:

1. A ventilation component, comprising a circumferential wall, wherein an outer circumferential surface of the circumferential wall forms an outer circumferential surface of the ventilation component, the circumferential wall is entirely formed by a wall portion, the wall portion being made of nonwoven fabric that has been subjected to thermal compression molding, the wall portion includes:

an inner layer that has air permeability; and an outer layer that is provided on a radially outer side of the inner layer and has elasticity, and the wall portion forms a vibration system including the inner layer as a mass portion and the outer layer as a spring portion, the vibration system having a partially varying natural frequency.

2. A ventilation component, comprising a circumferential wall, wherein an outer circumferential surface of the circumferential wall forms an outer circumferential surface of the ventilation component, the circumferential wall is entirely formed by a wall portion, the wall portion being made of nonwoven fabric that has been subjected to thermal compression molding, the wall portion includes:

an inner layer that has air permeability; and an outer layer that is provided on a radially outer side of the inner layer and has elasticity, the wall portion forms a vibration system including the inner layer as a mass portion and the outer layer as a spring portion, the vibration system having a partially varying natural frequency, and the outer layer has air permeability and a partially varying thickness.

3. The ventilation component according to claim 2, wherein the inner layer has a higher density than the outer layer.

4. The ventilation component according to claim 2, wherein the outer layer includes an air permeable portion, which has air permeability, and a non-permeable portion, which does not have air permeability, and the air permeable portion is arranged at a position corresponding to an antinode of a standing wave of a sound wave of air flowing through a space on an inner side of the circumferential wall.

* * * * *